United States Patent [19]

Gerrans

[11] 3,968,818

[45] July 13, 1976

[54] TRAY LOADING APPARATUS

[75] Inventor: Alfred W. Gerrans, San Jose, Calif.

[73] Assignee: Sunsweet Growers, Inc., San Jose, Calif.

[22] Filed: Oct. 1, 1971

[21] Appl. No.: 185,547

[52] U.S. Cl. ..... 141/78; 99/537; 141/82

[51] Int. Cl.[2] ..... B67C 3/02; B65B 1/20

[58] Field of Search ..... 141/78, 82, 125, 280, 141/74, 12; 214/308; 34/164, 236; 53/126–127, 247, 250; 259/DIG. 24; 198/59.60

[56] References Cited

UNITED STATES PATENTS

| | | | |
|---|---|---|---|
| 1,860,720 | 5/1932 | Norgaard | 141/125 X |
| 2,010,220 | 8/1935 | Cocks | 141/78 |
| 2,416,039 | 2/1947 | Albertoli | 141/78 |
| 2,557,181 | 6/1951 | Flack | 141/78 |
| 2,873,771 | 2/1959 | Gerrans | 141/131 |
| 3,096,081 | 7/1963 | Helm | 141/78 |
| 3,217,760 | 11/1965 | Eisenberg | 141/78 |
| 3,391,472 | 7/1968 | Landers | 34/236 X |
| 3,422,593 | 1/1969 | Gerrans | 53/250 X |
| 3,587,674 | 6/1971 | Adkin | 141/78 |
| 3,589,028 | 6/1971 | Hinton | 34/236 X |
| 3,618,224 | 11/1971 | Duc | 34/236 X |
| 3,651,922 | 3/1972 | Ross | 34/236 X |
| 3,667,135 | 6/1972 | Rowell | 34/164 X |
| 3,712,347 | 1/1973 | Andersen | 141/78 X |

*Primary Examiner*—Leonard D. Christian
*Assistant Examiner*—R. Pous
*Attorney, Agent, or Firm*—Paul B. Fihe

[57] ABSTRACT

Apparatus for loading trays with a single layer of prunes or other articles including a series of conveyors for moving the trays in sequence under a feed mechanism, the conveyor under such feed mechanism being vibrated so that the prunes are spread evenly in a compact layer on the tray on such vibrating conveyor.

8 Claims, 4 Drawing Figures

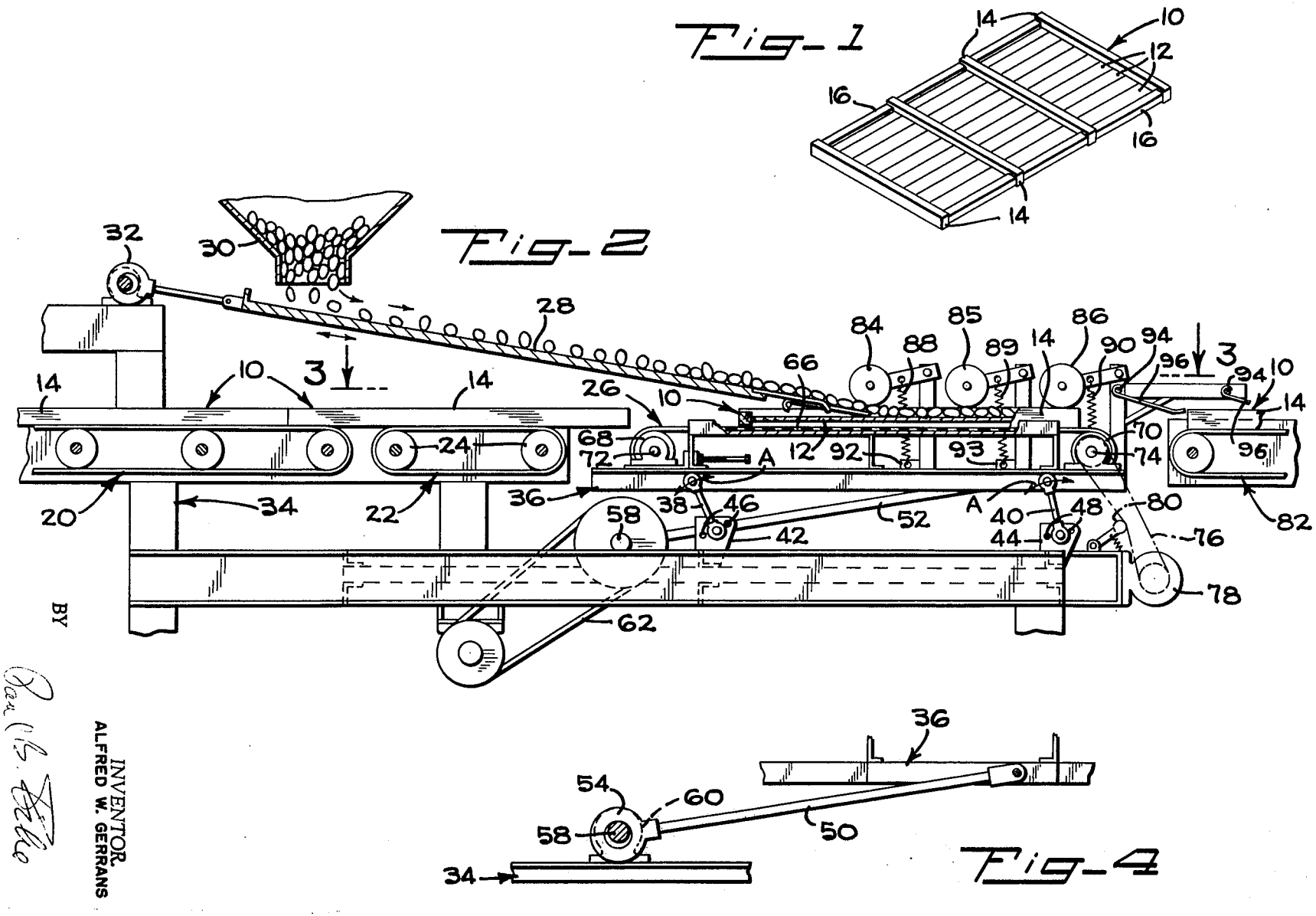
INVENTOR.
ALFRED W. GERRANS
BY
PATENT AGENT

INVENTOR.
ALFRED W. GERRANS

BY

Paul B. Eike

PATENT AGENT

TRAY LOADING APPARATUS

FIELD OF THE INVENTION

The present invention relates generally to tray loading apparatus and more particularly, to apparatus for loading articles such as prune plums in a single layer on trays preparatory to subsequent dehydration operations.

BACKGROUND OF THE INVENTION

In order to process green fruits such as prune plums to produce dried prunes, it has been the practice for many years to arrange the green fruit in a single layer on drying trays for passage through a dehydrator wherein hot air is arranged to remove moisture therefrom to produce the finished product. As a practical matter, the hot air delivered to the dehydrators is maintained at or below 180°F so that the moisture can be removed without adverse effects on the characteristics of the fruit such as a "caramelization" which would destroy the flavor characteristics of the product. In practice, it has been found that at the preferred temperature, a minimal dehydration period of approximately 14 hours is requisite. Quite obviously, this period would be required whether a single prune plum were placed on the tray or the tray were filled to capacity. As a consequence, over the years, dehydrators have assumed the form of elongated tunnels through which stacks of trays can be slowly passed on carts or the like, the individual trays being formed so that they can be stacked in a fashion which permits full contact of the drying air with the fruit on each tray in a stack.

In order to place the green fruit on the trays preparatory to the dehydration operation, mechanism such as disclosed in my prior U.S. Pat. No. 3,107,800 is conventionally utilized and in effort to maximize the amount of fruit on an individual tray, loading apparatus such as disclosed in the patent of W. L. Gerrans U.S. Pat. No. 2,873,771 has been utilized. In the latter patent, closely compacted green fruit is delivered from a shaker table onto trays which are arranged to move sequentially thereunder for reception of the fruit from the shaker table but, in such transfer, it has been found that a more widely spaced distribution of the fruit on the receiving tray occurs so that a limited amount of fruit is deposited thereon. More particularly, even though the fruit is so arranged on the shaker table to provide substantially 100% coverage in a single layer thereon, the fruits on the receiving tray typically provide only 80% coverage resultant from the natural tendency of the transferred fruits to bounce off one another thus to leave certain spacing therebetween. Accordingly, since the drying temperature is limited and the consequent drying time is consequently restricted, as explained hereinabove, full utilization of the dehydrator is not realized. Since the primary bottleneck in the dried fruit processing resides in the dehydrator because of the fourteen hour drying time and because of the fact that the green fruit should be processed rapidly during the relatively short harvest season (six weeks) an excessive number of dehydrators has seemed mandatory.

SUMMARY OF THE PRESENT INVENTION

Accordingly, it is the objective of the present invention to provide a tray loading apparatus which maximises the amount of fruit on an individual tray to, in turn, maximize utilization of the dehydrators in the processing of green fruits although it will be appreciated that this objective may be generalized to maximize the compaction of other articles delivered to trays or other receptacles of a similar nature. Briefly, this objective is achieved by delivering the green fruit or other articles onto the surface of a tray conveyed under the delivery or feed mechanism at the same time that the tray itself is subjected to vibration so as to urge the fruit to assume a compact single layer relationship on the tray surface thus to maximize the number of fruits on a given tray. More particularly, the trays are moved sequentially along a series of conveyors including one conveyor disposed immediately under the exit end of the feed or delivery mechanism for the articles which conveyor itself is subjected to a vibratory action so that the tray resting thereon has the same vibratory action imparted thereto so as to effect a vibratory crowding or compaction of the individual articles (green fruit) thereon so that substantially 100% coverage of the tray is attained.

The trays themselves each are formed with perimetral ribs or rails which confine the fruits or other articles to the tray loading surface and because of the vibratory action, any fruits or other articles delivered initially to such ribs or rails are subjected to vibratory action which moves the fruit from the rib to the tray surface and thereafter maintains the fruit in a single layer confined within the perimeter-defining ribs or rails of each individual tray, thus to avoid fruit loss during subsequent tray stacking or other handling operations.

Preferably, the vibratory conveyor is mounted so that the vibratory action imparted thereto at the tray entrance end is differentiated from that at the tray exit end. More particularly, the character of vibratory motion imparted to the conveyor adjacent its entrance end is such as to create a considerable forward impetus to the fruit to maximize compaction thereof in a single layer on the tray whereas, on the other hand, the vibratory action imparted to the conveyor towards its exit end is relatively quiescent so that the already compacted fruit is not dislodged from its compact relationship. Means are provided to enable adjustment of the character of vibratory motion so that fruits or other articles of various characteristics can be accommodated to produce the desired close compaction on the tray.

Preferably, the trays are moved sequentially along a substantially horizontal path on the vibratory conveyor and the vibratory action imparted to the conveyor and the tray resting thereon includes a substantially horizontal component but also particularly at its entrance end a slight vertical component of motion thus to facilitate forward compacting motion of the individual fruit or other articles. To assure that the tray itself partakes of such vibratory motion including both its vertical and horizontal components, resilient members are arranged to engage the upper edges of the tray to hold the same against the vibrating conveyor.

BRIEF DESCRIPTION OF THE DRAWINGS

The stated objective of the invention and the manner in which it is carried out, as summarized hereinabove, will be more readily understood by reference to the following detailed description of the exemplary apparatus shown in the accompanying drawings which is adapted to effect loading of a plurality of fruit-drying trays sequentially with a single compact layer of prune plums. In such drawings, FIG. 1 is a perspective view of a conventional fruit-drying tray capable of receiving fruit in a single layer on its upper surface and also capable of being stacked on its edges with other trays preparatory to delivery to a dehydrator, FIG. 2 is a side elevational view, partially broken away, illustrating an apparatus for loading trays of the type shown in FIG. 1 in sequence with a single layer of prune plums, FIG. 4 is a sectional view taken substantially along line 4—4 of FIG. 3 illustrating details of the mechanism for imparting vibratory motion to the conveyor and a tray resting thereon.

DETAILED DESCRIPTION OF THE EXEMPLARY EMBODIMENT OF THE INVENTION

Figure 3:
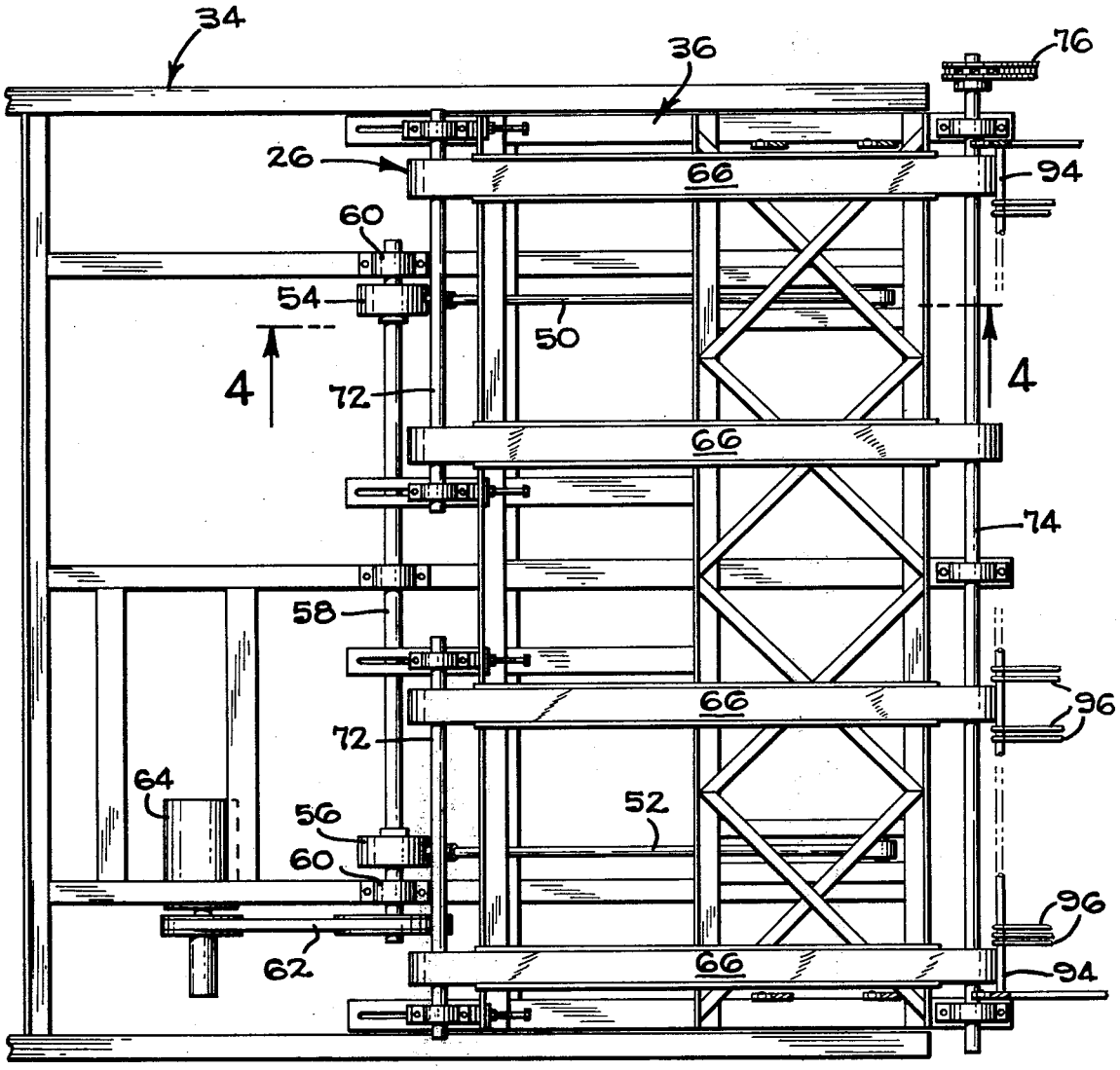
FIG. 3 is a top elevational view of a vibratory conveyor taken substantially along line 3—3 of FIG. 3.

With initial reference to FIG. 1 a standard fruit drying-tray 10 of the type employed in carrying out the present invention for the processing of prunes includes a large number of co-planar thin fruit-supporting slats 12 that are held in slightly spaced co-planar relation by four relatively thick parallel ribs or rails 14 which are suitably secured to the slats both at intermediate positions and at their respective ends thus to divide the tray into three fruit-supporting sections. Additionally, to confine the single layer of fruits endwise to the surface of the slats, other relatively thin ribs 16 are secured to the ends of the described supporting ribs 14 so that in effect a low wall is formed about the entire periphery of the tray. Preferably, the four thicker ribs 14 are of sufficient dimensions so that when the trays are stacked, the relatively thin ribs 16 are spaced by at least two inches thus allowing the ingress and egress of heated air during dehydration operation.

In conventional fruit processing operations such as transfer through a dehydrator, it is conventional to stack twenty-six of the trays 10 on a cart (not shown) and after the dehydration operation has been completed, the stack of trays with the dried prunes or other fruits thereon is delivered to a loading apparatus of the general type shown in my prior U.S. Pat. No. 3,107,800 wherein the stacked trays are first separated and unloaded whereupon the empty trays are delivered over a sequence of conveyors along a substantially horizontal path. During such conveyance, each tray passes under a fruit feeding or delivery mechanism of a type shown in that patent or as shown in an improved version in the patent of W. L. Gerrans U.S. Pat. No. 2,873,771 which is generally arranged to discharge the green fruit in a single layer onto each tray 10 as it passes sequentially thereunder. After such loading operation, the trays are once again stacked preferably in the fashion shown in U.S. Pat. No. 3,107,800 whereupon 26 loaded trays on a cart may be delivered to the dehydrator.

In accordance with the present invention, the individual trays 10 are moved in sequence along a series of conveyors, the first of which as illustrated in FIG. 2 constitutes a powered endless belt conveyor 20 arranged to engage the four thick ribs 14 of the tray 10 on their undersurfaces to effect a continuing frictionally-propelled advance of the sequence of trays in abutting relationship as clearly illustrated in FIG. 2 from the left to the right. From such powered conveyor 20, the trays 10 are arranged to pass across an idler conveyor 22 in the form of an endless belt trained about two rollers 24 so that the upper flight thereof is in co-planar relationship with that of the entrance powered conveyor 20 and is, in turn, in substantial horizontal alignment with the upper flight of another powered endless belt conveyor 26, the central portion of which underlies the exit end of an inclined shaker table 28 preferably of the type shown in the referred to U.S. Pat. No. 2,873,771 that is arranged at its entrance end to receive fruit from a suitable hopper 30 and is subjected to vibratory action by a mechanism generally indicated at 32 so that the green fruits arrange themselves in a single layer prior to their discharge from the lower exit end of such shaker table onto a tray 10 on the receiving conveyor 26 thereunder.

Whereas both the powered entrance conveyor 20 and the idler conveyor 22 are supported from a rigid frame indicated at 34, the receiving conveyor 26, that is, the conveyor which supports the trays 10 to receive fruits from the shaker table 28 is supported on a separate generally rectangular subframe 36 which is supported for limited motion from the rigid frame 34 by six pivot arms 38, 40 at its respective corners and midway therebetween two of which are clearly shown in FIG. 2 at one side, two of which are centrally disposed and the final two of which are similarly arranged at the opposite side of the rectangular conveyor subframe. More particularly, each pivot arm 38, 40 is pivotally secured to the subframe 36 at its upper end and is similarly pivotally secured to a bracket 42, 44 rigidly mounted on the main frame 34 of the machine. Preferably, each of the brackets 42, 44 includes three holes 46, 48 which permit a variation in the precise disposition of the pivotal support at the lower extremity of each of the pivot arms 38, 40 wherefore a variation in the character of motion of the pivotally supported subframe 36 is enabled. If the lower pivotal position of the rearward arm 38 is in the central hole 46 as shown in FIG. 2, the disposition of the upper pivotal connection of the arm to the moveable subframe 36 is displaced approximately two inches horizontally so that if the pivot arm is moved about the fixed pivot on the main frame to and fro in the direction of the arrows A in FIG. 2, the subframe 36 will at this position have a substantial horizontal component and a much slighter vertical component of motion during such pivoting. In turn, if the forward pivot arm 40 is mounted at its lower end in the central pivot hole 48, a forward displacement of approximately one inch between this fixed pivot and the moveable pivot on the supported subframe 36 is achieved so that the motion of the subframe at this point of pivotal support is predominantly horizontal with a lesser vertical component. Horizontally, the other support holes 46, 48 in the brackets 42, 44 are spaced approximately 1 inch on either side of the central holes so that, for example, if the foremost pivot arm 40 were secured in the rearmost pivot hole 48, its central position would be substantially vertical and as a consequence, a very minimal amount of vertical motion of the subframe 36 would occur when the subframe 36 were moved to and fro. In turn, if the rearmost pivot arm 38 were mounted in the rearmost hole 46, a horizontal displacement of but one inch between the fixed pivot point and the moveable pivot point would be obtained so that a lesser vertical component of motion would occur if the subframe 36 were moved to and fro from such position.

In order to actuate motion of the conveyor-supporting subframe 36 on the described pivot arms 38, 40, a pair of rods 50, 52 are secured by pivot pins to the subframe as can best be visualized by reference to FIGS. 3 and 4 at their forward extremities and are pivotally secured at their rearmost extremities similar to eccentrics 54, 56 mounted on a common shaft 58 supported in a suitable bearing 60 on the main frame 34 and driven through a suitable belt and pulley connection 62 from a variable speed drive motor 64. The amount of eccentricity is preferably approximately one-sixteenth of an inch so that the total reciprocatory stroke of the pair of actuating rods 50, 52 is approximately one-eighth inch in the direction of travel of the trays 10. Thus, a vibratory to and fro motion of the subframe 36 and the conveyor 26 thereon is achieved which because of the particular mounting arrangement of the described pivot arms 38, 40 creates a substantial horizontal reciprocation of the subframe and the conveyor 26 mounted thereon of slightly less than ⅛ inch and a vertical motion which at the rear end of the subframe 36 amounts to approximately one thirty-second of an inch and at the forward end is negligible. Preferably, the rate of eccentric actuation is approximately 500 strokes per minute for handling of prune plums.

Preferably, the receiving conveyor 26 takes the form, as best shown in FIG. 3 of four parallel endless belts 66, each mounted on rollers 68, 70. The rollers 68, 70 are supported on the subframe on parallel shafts 72, 74 one of which constitutes an idler shaft 72 and the other of which is connected at its one extremity, as best shown in FIG. 2, by a sprocket and chain connection 76 to a variable speed drive motor 78 mounted on the main frame 34, the slight motion of the vibratory subframe 36 being accommodated by engagement of the sprocket chain with a spring-urged idler sprocket 80.

After each tray 10 has passed over the vibrating conveyor 26, it then moves onto another aligned conveyor 82 for ultimate stacking or other disposition in the manner described in the previously referred to U.S. Pat. No. 3,107,800. In the case of handling fruit-drying trays 10 of the type shown in FIG. 1 and whose length in the direction of travel across the conveyors is approximately three feet, the described vibratory conveyor 26 preferably has an overall length of approximately four feet and the two conveyors 22, 82 forwardly and rearwardly thereof are spaced therefrom approximately by a distance of one foot. In turn, since the exit end of the described shaker table 28 which feeds or delivers fruits onto the trays 10 sequentially has its discharge end positioned at the mid-point of the vibratory conveyor 26, two-thirds of the length of an individual tray 10 will rest on the vibratory conveyor 26 prior to the delivery or feeding of any fruits thereto thus to provide substantially sole support for that tray so that it can fully partake of the vibratory action during the delivery of fruits thereto. Since the prior idler conveyor 22 is spaced approximately one foot from the vibratory conveyor, this individual tray is substantially freed from any contact therewith so that no interference with the vibratory action will occur. In turn, when the delivery of fruits to a particular tray 10 is being completed, approximately 2 feet or two-thirds of the tray is still resting on the vibratory conveyor 26 and no contact has yet been made with the succeeding conveyor 82 in the line so that again no interference with vibratory action will exist. The conveyor 82 is a standard frictional belt conveyor which allows continued vibratory motion of a tray 10 even after contact therewith has been made and is driven at a higher speed so that a tray moved thereonto from the vibratory conveyor 26 quickly moves out of abutting contact with a succeeding tray so as not to interfere with the vibratory action of the latter tray.

In order to assure that each tray fully partake of the vibratory action of the tray-supporting conveyor 26, three sets of four hold-down rollers 84, 85, 86 are arranged to engage each tray rib 14 at each edge of the tray and are urged downwardly thereagainst by springs 88, 89, 90 secured between roller-supporting shafts and fixed mounting brackets 92, 93 which are secured to the main frame 34 of the unit two of which are shown in FIG. 2. Thus, for vibration purposes, the tray 10 and the supporting vibratory conveyor 26 can be considered as a unit.

As the fruits are delivered from the shaker table 28 onto an individual tray 10, the vibratory action serves to urge the fruits towards the forward end of the tray 10 and this forward motion is enhanced when the fruits first arrive on the tray because of the relatively large vertical component of vibratory motion at the rear end of the vibrating conveyor and the trays supported thereon whereas to the contrary as each tray moves to the foremost end of the vibratory conveyor, the lessened vertical component of motion reduces the forward forces imparted to the fruits so that they are merely maintained in a closely-compacted single layer on the tray. Any fruits initially delivered to the thin ribs 16 at the front or rear ends of the trays are dislodged onto the preceding tray to thereafter be confined within the peripheral ribs 14, 16 so that subsequent loss of fruits is effectively avoided. Preferably, above the space between the vibratory conveyor 26 and the succeeding conveyor 82, wiper means in the form of two rows 94, 96 of pivoted fingers are supported and are urged downwardly against the prunes on the loaded tray to cleanse any prunes from the tray ribs 16 and to restrain further advance of prunes onto and over the ribs 16 after a preceding tray has been accelerated by the succeeding conveyor 82.

As previously mentioned, a single tray 10 loaded with the described apparatus holds as much as 20% more fruit. As a consequence, four dehydrators can now handle as much fruit as five with previous loading mechanisms. Furthermore, fewer trays need be employed and labor costs are accordingly reduced by the same mentioned percentage so that the overall saving in capital equipment as well as labor is significant.

Various modifications of the specifically described apparatus can be readily envisioned to meet particular needs, such as loading of apricots or other articles and accordingly the foregoing description is purely exemplary and the actual scope of the invention is to be indicated only by the appended claims.

What is claimed is:

1. Apparatus for loading trays with a single layer of articles which comprises means including a powered belt conveyor for conveying a tray along a substantially horizontal path, means for delivering articles to the upper surface of the tray during conveyance thereof, and means for vibrating said tray-conveying means during the delivery of articles to the tray whereby the tray thereon is vibrated during its conveyed movement and the articles are closely compacted thereon, said vibrating means imparting a reciprocal motion to said tray-conveying means including a vertical component of motion and a horizontal component of motion in the direction of conveyance.

2. Apparatus for loading trays according to claim 1 wherein, said vibrating means is arranged to impart greater vertical notion to said tray-conveying means at its input end then at its output end.

3. Apparatus for loading trays according to claim 1 which comprises, means for adjusting the vertical component of motion of said tray-conveying means.

4. Apparatus for loading trays according to claim 1 wherein, the rate of vibration imparted to said tray-conveying means by said vibrating means is variable.

5. Apparatus for loading trays according to claim 1 which comprises, means for resiliently holding each tray against said tray-conveying means during vibration thereof.

6. Apparatus for loading trays according to claim 1 wherein, said article-delivering means is arranged to discharge articles onto a tray at a position substantially midway the length of said tray-conveying means and wherein, said tray-conveying means is sufficiently long so that substantially the entire weight of a tray is supported thereon during delivery of articles thereto.

7. Apparatus for loading trays according to claim 6 which comprises, tray conveyor means on both ends of said vibrated tray-conveying means for sequentially moving trays thereto and therefrom.

8. Apparatus for loading trays according to claim 7 which comprises, wiper means arranged to engage articles on a tray at a position between the end of said vibrated tray-conveying means and the succeeding one of said tray conveyor means.

* * * * *